United States Patent [19]

McKie

[11] Patent Number: 4,919,344

[45] Date of Patent: Apr. 24, 1990

[54] GRINDING MILL APPARATUS

[76] Inventor: Robert T. McKie, 2222 Stephen Ave., Boise, Id. 83706

[21] Appl. No.: 361,444

[22] Filed: Jun. 5, 1989

[51] Int. Cl.[5] ..... B02C 18/18

[52] U.S. Cl. ..... 241/32; 241/88.4; 241/285 R; 241/191

[58] Field of Search ..... 241/285 B, 285 R, 189 R, 241/191, 32, 73, 88.4, 285 A

[56] References Cited

U.S. PATENT DOCUMENTS

| | | | |
|---|---|---|---|
| 1,706,643 | 3/1929 | Wiley | 241/285 B X |
| 1,772,321 | 8/1970 | Ossing | 241/32 |
| 1,877,121 | 9/1932 | Borton | 241/32 |
| 2,767,928 | 10/1956 | Hanse et al. | 241/285 B X |
| 3,220,658 | 11/1965 | Shelton | 241/32 |

FOREIGN PATENT DOCUMENTS

| | | | |
|---|---|---|---|
| 887040 | 11/1971 | Canada | 241/32 |
| 450481 | 9/1927 | Fed. Rep. of Germany | 241/32 |

*Primary Examiner*—Mark Rosenbaum

*Attorney, Agent, or Firm*—Paul F. Horton

[57] ABSTRACT

Grinding mill apparatus for grinding biomass, said apparatus including a substantially box-like steel housing having a top inlet and a bottom outlet; a plurality of anvils pivotally engaging the housing and held in a fixed position by shear pins; a rotor mounted for rotation about a horizontal axis within the housing, the rotor provided with cutting bars orbiting in close proximity to the anvils for fragmenting the biomass; and a grate system for discharging material of a desired size through the outlet of the housing. The housing includes a back wall which is integral with the side walls for reducing metal fatigue and also includes a side wall access opening with access cover for insertion and removal of the cutter bars of the rotor and insertion and removal of grate member sections. The rotor includes two or more sections, each section defining a portion of a cylinder axially offset from adjacent sections for aerodynamic reaons and for reasons of strength. The rotor includes a cavity filled with a lead-antimony alloy to increase the strength of the rotor.

18 Claims, 2 Drawing Sheets

GRINDING MILL APPARATUS

BACKGROUND OF THE INVENTION

1. Field of the Invention

This invention relates to a grinding mill for dirty biomass and similar material; for fuel; for mulch; and for small particle generation.

2. Description of the Prior Art

Biomass mills are known which include a strong housing; a heavy duty rotor with affixed cutter bars; an anvil that can release on striking an uncrushable piece of metal or the like; and a discharge grate that allows only sized material to pass out of the mill.

Many grinding machines of variable design have been patented which are used in generating hog fuel from sawmill wood waste. Many of these machines use swing hammers, as typified by Strom, U.S. Pat. No. 4,000,836, that can be made to wear on both sides by reversing the machine rotation direction. Other machines wear both ends of the striking device by removing it and replacing the device in a reversed orientation, as shown by Kessler, U.S. Pat. No. 2,585,943. Such machines have significant shortcomings. The Strom device, in reversing rotation, causes a great loss in capacity as feed cannot properly fall into the nip of the rotor in the reversed direction. Removal and reorientation of the striker bar of Kessler requires entry into the mill itself, at great cost and time.

Other known biomass mills, such as that of Konig et al, U.S. Pat. No. 4,049,206, have striker elements that protrude abruptly out from the rotor shaft without concern for the air horsepower loss that this lack of streamlining causes, and have a full width impact anvil with two point support, which decreases sensitivity.

SUMMARY OF THE INVENTION

The present invention overcomes these and other problems in the prior art by providing grinding apparatus which includes a readily accessible housing; a plurality of anvils; a specially designed rotor and a unique grate system.

It is a general object of the present invention to provide improved grinding apparatus for grinding wood waste, household garbage, tires, railroad ties, demetalized construction debris, agricultural waste, coal, plastics, and similar material.

It is a primary object of the present invention to provide improved grinding apparatus having an aerodynamic rotor having cutter bars with increased backing strength.

Another object of the present invention is to provide improved grinding apparatus with reversible cutter bars which are readily accessible for maintenance.

Another object of the present invention is to provide improved grinding apparatus with a slip-in grate system which is readily accessible for maintenance.

It is still another object of the present invention to provide improved grinding apparatus having three or more hinged anvils with individual shear pins for better response to "local" overload from uncrushable metal tramp.

An additional object of the present invention is to provide improved grinding apparatus having a housing with integral back and side walls to resist fatigue better than the conventional welded or bolted walls.

It is also an important object of the present invention to provide improved grinding apparatus having a stepless rotor shaft do eliminate shaft failure due to stress concentration caused by shaft shoulders, while also reducing construction cost.

It is also an important object of the present invention to provide improved grinding apparatus having a rotor filled with a molten lead-antimony alloy for increasing rotor strength and for providing a solid backing for rotor cutter bars.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
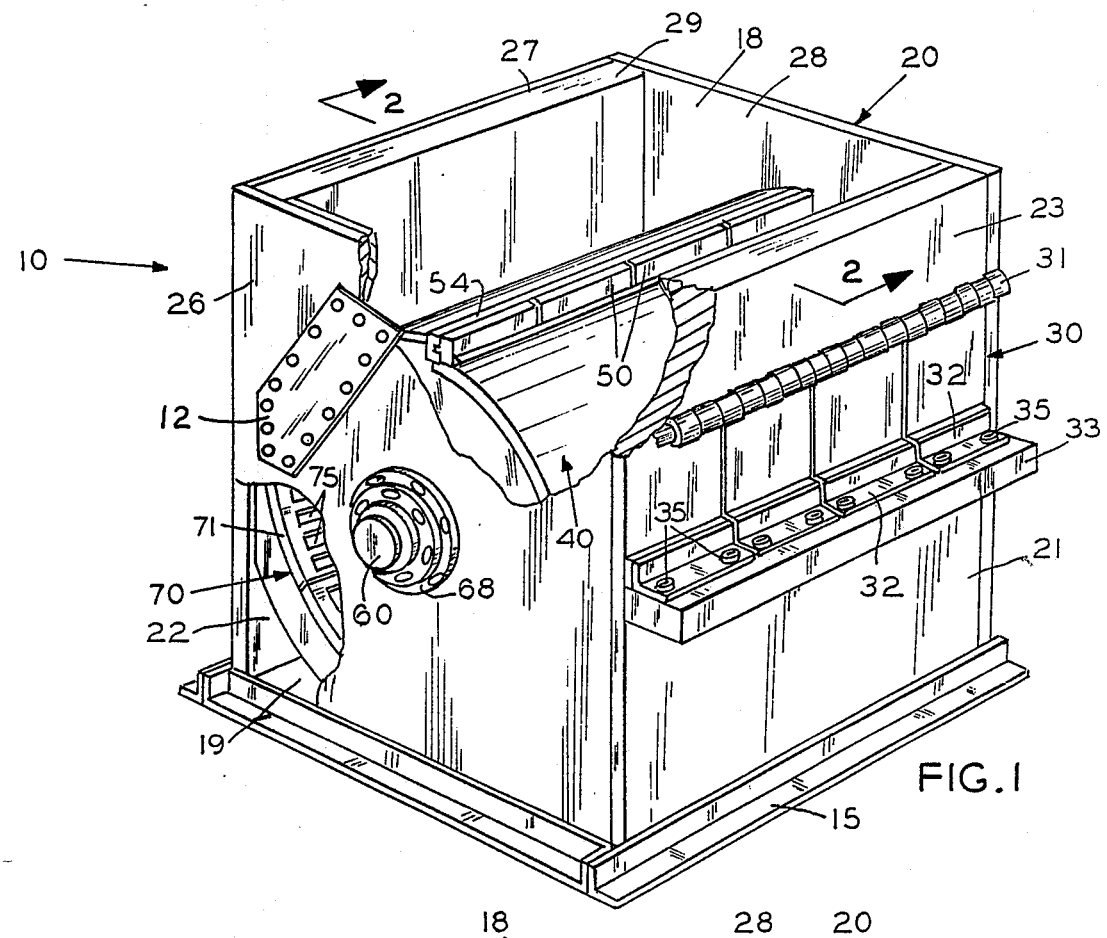
FIG. 1 is a perspective view, in partial section, of a preferred embodiment of the present invention.

Referring now to the drawings and to FIG. 1, in particular, grinding mill apparatus 10 made according to the present invention, and for the grinding of biomass, is disclosed. Apparatus 10 includes generally a housing 20; anvils 30 pivotally engaging the housing; a rotor 40 mounted upon a shaft 60 for rotation about a horizontal axis within said housing; and grate means, designated generally by the numeral 70.

Figure 2:
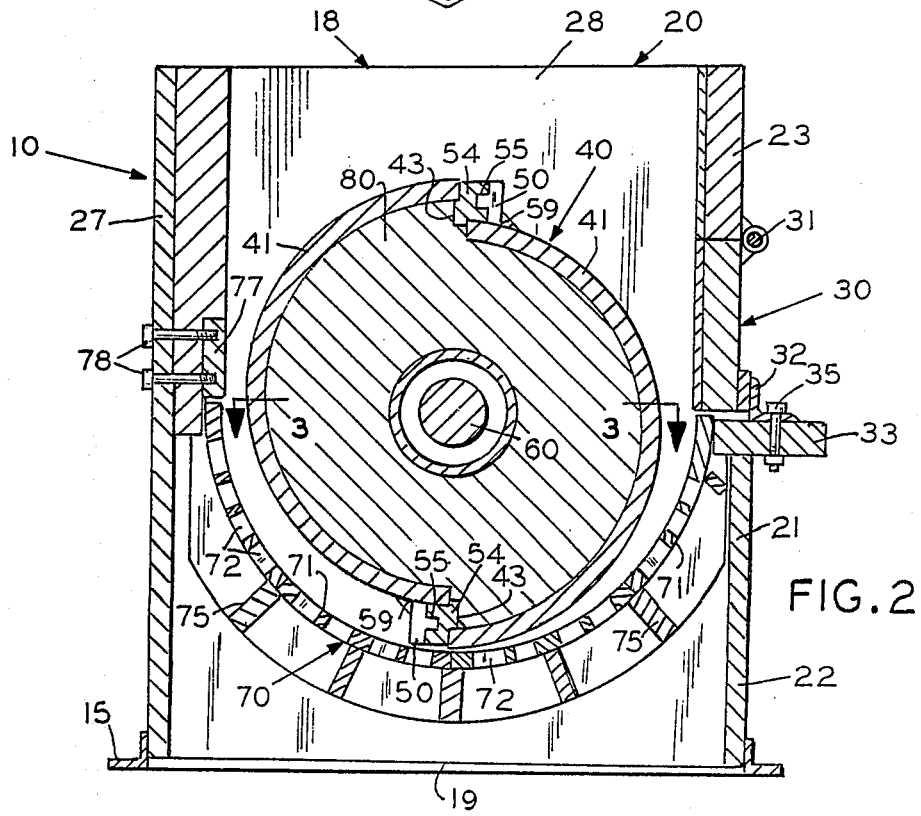
FIG. 2 is a section view taken along lines 2——2 of FIG. 1.

Housing 20, shown to advantage in FIGS. 1 and 2, is preferably constructed of heavy steel plate and is substantially box-like in construction having a front wall 21, a back wall 27 and a pair of opposing side walls 26 and 28, respectively. The back wall and side walls are integral with one another, being built from one piece of steel plate bent to define the back wall and end walls to eliminate welding and bolts for superior strength and to better resist metal fatigue. The back wall may be provided with a form fitting reinforcement block 29 to help keep the ends parallel and the housing extremely rigid. Front wall 21 of the housing is provided with a stationary fixed anvil face 23, extending from the top of the housing down about one-fourth of the housing height, and a housing cover plate 22, extending upward from base 15. The housing defines a top opening, inlet 18, for reception of the material to be ground and a bottom opening, outlet 19, for discharge of material exiting through grate means 70. A grinder access opening, not shown, covered by access plate 12 is provided for reasons which will hereinafter be more fully explained.

Directly below fixed anvil face 23 and pivotally attached to the front wall of the housing by hinges 31 are one or more and preferably three or more anvils 30 which are operable to swing outwardly from the housing when shearing means, in the form of shear bolts or pins 35, fail. The hinged anvils are about one-fourth the height of front wall 21 of grinder housing 20. Directly below anvils 30 is the end to end anvil shear bolt connection beam 33 which carries, by means of L-shaped shear plates 32 and bolts 35, the anvil bottoms working forces to the end walls of the housing to which beam 33 is connected as by welding and/or bolts, not shown.

Figure 3:
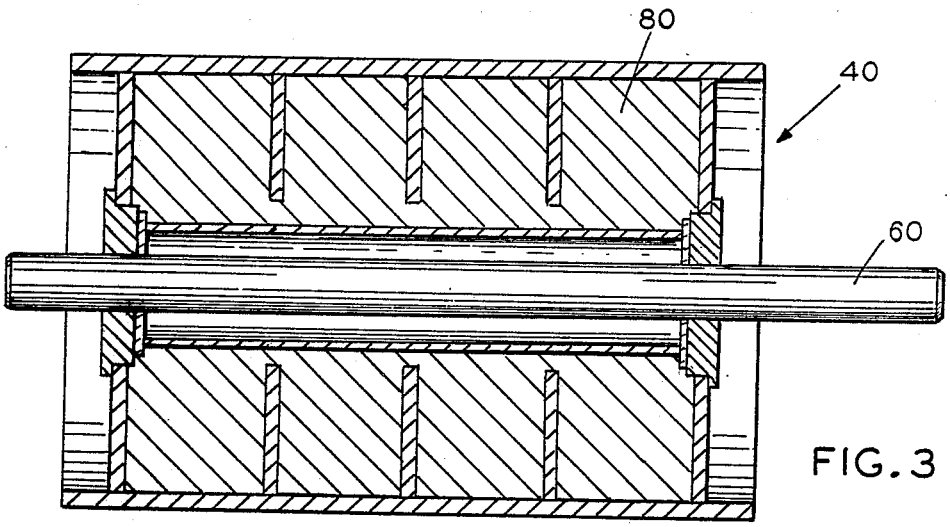
FIG. 3 is a vertical section view taken along lines 3——3 of FIG. 2.
Figure 4:
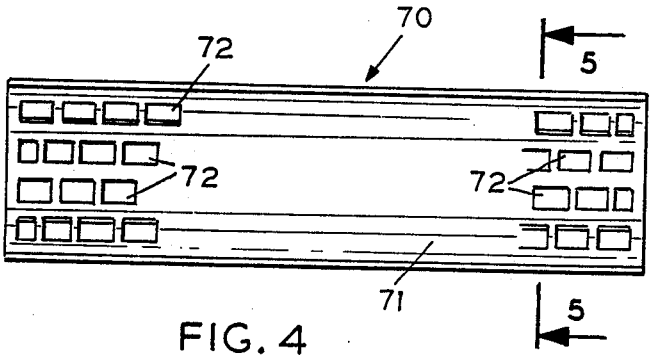
FIG. 4 is a top view of one section of the qrate of the present invention.
Figure 5:
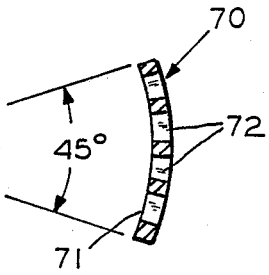
FIG. 5 is a section view taken along lines 5——5 of FIG. 4.

Rotor 40, shown to advantage in FIGS. 1, 2, and 3, mounted within housing 20, has its axis parallel to front wall 21 and about at the vertical and horizontal middle of the housing side walls 26 and 28. Rotor axle shaft 60 is mounted in the side walls by suitable piloted flange bearings 68. One end of the shaft is extended from the bearing to carry a coupling or sheave for driving. The shaft is completely cylindrical, of stepless design, to eliminate fatigue problems associated with stress concentration at shaft shoulders. This stepless construction also simplifies bearing positioning and rotor centering. Removable, bolt-in locking rings, shown in FIG. 3, are used to transmit torque and the rotor is held in position by the tapered seat of standard piloted flange double row spherical bearings, above referred to. Rotor 40 is specially shaped to provide the proper strong mounting surfaces 43 for cutters 50 while providing a streamlined aerodynamic efficient design of a continuous constant radius curve extending from the top back of one cutter to the base of the following cutter, as may be seen to advantage in FIG. 2. This same streamlined rotor surface design is used whether there is one, two, three, or more cutters mounted on the rotor. The rotor comprises two or more sections 41, two sections being shown. Each section defines a portion of a cylinder axially offset from adjacent sections to define cutter mounting surfaces 43. Such structure, in being aerodynamic, reduces air horsepower losses; provides a structural design that passes cutter impact loads directly into the rotor; and provides a downward moving surface to prevent material being ground from rebounding away from the anvil face 23 and anvils 30. Referring now to FIG. 3, it will be seen that the rotor includes one or more cavities filled with an alloy fill 80. The alloy fill triples the end to end strength of the steel rotor; substantially increasing the inertia of the rotor. For the fill, an alloy containing lead in the range of ninety five to ninety nine percent and antimony in the range of one to five percent is used. This lead-antimony fill provides an inexpensive, after construction, strong back bone to the rotor; allows the rotor cavities to be filled with the molten metal at a low enough temperature so as not to harm or warp the confining steel plate structure of the rotor; does not contract upon cooling, as does lead; and yet provides compressive and yield strength three times that of commonly used lead filler. It is also to be noted that the shape of the rotor provides a confining shape to the alloy fill to prevent the fill from spinning free from the contact surfaces of the cutters in that the alloy fill is impacted directly behind the cutters; the impact being imparted to the entirety of the rotor.

Figure 6:
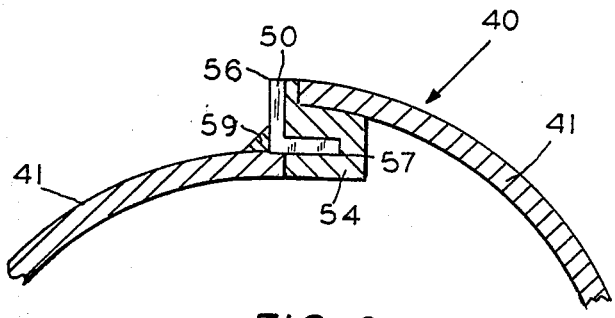

Cutters 50 are preferably in the form of elongated bars, tee-shaped, as shown in figures one and two, or L-shaped, as shown in FIG. 6, in cross section. The cutter bars are held firmly in place by cutter retention bars 54, extending across mounting surfaces 43, and having cutter retention slots 55 for receiving the cutter bars. A stop piece 59, affixed to the rotor in front of the cutter bar, shown to advantage in FIG. 6, prevents forward displacement of the bar. Such construction allows end removal of the cutter bars from the slots by means of access cover 12 and allows for a cutter bar or cutter bars of desired length--four cutter bars being shown in FIG. 1, for each slot. For removing cutter bars frozen in place, a jack-screw, not shown, may be set in side wall 28 of housing 20, opposite access plate 12. While other bars 50, having a different cross sectional design than the tee-shape or L-shape shown, may be used, these bars provide a double cutting edge 56 and 57 so that the bar need simply be reversed to provide a new cutting edge at the periphery of the rotor.

Grate means, designated generally by the numeral 70 and shown to advantage in FIGS. 1, 2, 4, and 5, are preferably formed of curved sections 71, each defining an arc of forty-five degrees. The four sections, having a multiplicity of openings 72 to define a desired mesh, are mounted on substantially semi-circular grate support ribs 75 extending between opposing side walls of the housing. The grate sections are held in their working position on ribs 75 by means of a grate lock bar 77, held in place by bolts 78, as shown in FIG. 2. Additional bolts, not shown, extending through the side walls may also be used to secure the grate sections in place. The grate construction, in cooperation with access cover 12, permits a novel way of inserting and removing grate sections without entering the grinder housing. For removal of the grate sections, bolts 78 and any side wall retention bolts are first removed; lock bar 77 removed through the access opening by removal of access cover 12; and anvils 30 pivoted outwardly after removal of shear pins 35. A force is then applied, as by pounding, to the end grate section nearest the anvils to force the back most grate section upwardly on the curved ribs 75 for removal through the access cover opening. This process is repeated until the final grate section is removed. For installation of the grate sections, the sections may be inserted through either the anvil opening or the access cover opening.

The arrangement of the cutter bars 50 on the streamlined shaped rotor 40 is preferably such that the clearance between the cutter bar edges and the anvils and grate sections, during orbit of the cutter bars, is, by design, very close, such as one eighth to one sixteenth of an inch clearance. This provides efficient shearing of fibrous materials. The speed of rotation of the mill should be varied with a recommended eighty feet per second cutter tip speed for coal; one hundred twenty five feet per second for biomass; and one hundred fifty feet per second for rubber. Material to be ground is continuously introduced into inlet 18 either being forced in by gravity when operating with the inlet on the top position or being forced in by a feeder when the inlet is one the top side of the grinder. When a large piece of material enters the grinder, the cutter bars 50, in their close orbit proximity to the anvils, breaks off a piece small enough to proceed ahead of the cutter bar into the space above grate sections 71. The piece of material is accelerated to the speed of the cutter bar and at one hundred twenty five feet per second it reacts to a centrifugal force of over 100 times gravity and is forced against the grate openings 72 where it makes consecutive collision with the back edge of the grate openings breaking the material into pieces small enough to escape through the grate openings to the outlet 19 of the grinder apparatus.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Grinding mill apparatus comprising:

a housing with inlet and outlet;

at least one anvils mounted within an opening of said housing, each of said anvils pivotally engaging said housing and each of said anvils provided with shear means for holding said anvils in a fixed break-away relationship with said housing;

a rotor mounted upon a shaft for rotation about a horizontal axis within said housing, said rotor comprising at least one sections, each section defining a portion of a cylinder axially offset from adjacent sections, each of said sections provided with a cutter having an orbit set at a selected distance from said anvils, and said rotor provided with at least one cavities, each of said cavities being filled with a lead-antimony alloy; and grate means affixed to said housing for passing materials of a selected size through said housing outlet.

2. The apparatus as described in claim 1 wherein said housing is box-shaped in configuration including a front wall, a back wall, and two side walls defining a top inlet and a bottom outlet, and at least one of said side walls including a grinder access opening with cover.

3. The apparatus as described in claim 2 wherein said housing is constructed of steel; wherein said anvils are mounted on said front wall; and wherein said back wall and said side walls are integral with one another for lessening metal fatigue.

4. The apparatus as described in claim 2 wherein said housing is provided with grate support ribs substantially semicircular in cross-section and wherein said grate means includes a plurality of grate sections mounted adjacently on said ribs, said grate sections slidable upon said ribs for insertion and removal through said access opening.

5. The apparatus as described in claim 4 wherein said grate means includes four sections, each having an arc of forty five degrees.

6. The apparatus as described in claim 2 wherein each of said rotor sections is provided with a cutter retention slot for mounting and dismounting each of said cutters through said access opening.

7. The apparatus as described in claim 6 wherein each of said cutters is provided with at least two opposing cutting edges; a respective cutting edge being exposed on the outer most periphery of said rotor upon reversed orientation of said cutter within said retention slot.

8. The apparatus as described in claim 1 including at least one anvils and wherein said shear means comprises at least two shear pins engaging each anvil.

9. The apparatus as described in claim 1 wherein said alloy includes antimony in a range of from one to five percent.

10. The apparatus as described in claim 1 wherein said rotor shaft is a stepless shaft.

11. Grinding mill apparatus comprising:

a box-like housing including a front wall, a backwall, and two side walls to define a top inlet and a bottom outlet and at least one grinder access opening in the upper back portion of one of said side walls, with cover;

a plurality of anvils, each of said anvils pivotally mounted within an opening of said front wall of said housing, each of said anvils provided with at least one shear pin engaging said housing to fragibly affix said anvil in a selected relationship with said housing;

a rotor mounted upon a shaft for rotation about a horizontal axis within said housing, said rotor provided with at least one cutter bar having an orbit set at a selected distance from said anvils and said rotor provided with at least one cavities filled with a lead-antimony alloy for increasing the strength of said rotor; and grate means affixed to said housing for passing materials of a selected size through said housing outlet.

12. The apparatus as described in claim 11 wherein said housing is constructed of steel and wherein said back wall and said side walls of said housing are integral with one another to reduce metal fatigue.

13. The apparatus as described in claim 11 wherein said rotor comprises at least two sections, each section defining a portion of a cylinder axially offset from adjacent sections and each section provided with a cutter bar.

14. The apparatus as described in claim 13 wherein each of said rotor sections include a cutter bar retention slot and wherein each of said cutter bars include at least two opposing cutting edges whereby reversing the orientation of said cutter bar within said slot exposes an opposing cutting edge to the outer periphery of said rotor.

15. The apparatus as described in claim 14 wherein said cutter bars are alignable with said access opening of said housing upon rotation of said rotor for insertion and removal of each of said cutter bars from respective retention slots.

16. The apparatus as described in claim 11 wherein said housing is provided with substantially semi-circular grate retention ribs and wherein said grate means comprises a plurality of sections retained on said ribs and slidable along said ribs for insertion and removal through said access opening of said housing.

17. Grinding mill apparatus comprising:

a box-like housing including a front wall, a back wall, and two side walls to define a top inlet and a bottom outlet; substantially semi-circular greate retention ribs; and at least one grinder access opening in the upper back portion of one of said side walls, with cover;

a plurality of anvils, each of said anvils pivotally mounted within an opening of said front wall of said housing, each of said anvils provided with at least one shear pin engaging said housing to frangibly affix said anvil in a selected relationship with said housing;

a rotor mounted upon a shaft for rotation about a horizontal axis within said housing, said rotor comprising at least two sections, each section defining a portion of a cylinder axially offset from adjacent sections, and each section provided with at least one cutter bar mounted with a retention slot, said cutter bar alignable with said access opening of said housing upon rotation of said rotor for insertion and removal of said cutter bar and said rotor provided with at least one cavities filled with a lead-antimony alloy for increasing the strength of said rotor; and grate means, said grate means including four grate sections for passing materials of a selected size through said housing outlet; each section having an arc of forty five degrees, said sections mounted upon said ribs of said housing for slidable engagement therewith for removal through said access opening of said housing.

18. The apparatus as described in claim 17 wherein said housing is constructed of steel and wherein said back wall and said side walls of said housing are integral with one another to reduce metal fatigue.

* * * * *